US011719498B2

(12) United States Patent
Kada

(10) Patent No.: US 11,719,498 B2
(45) Date of Patent: Aug. 8, 2023

(54) TRIGGER DEVICE FOR A BUTTSTOCK LOADER

(71) Applicant: KaWaTec GmbH, Leibnitz (AT)

(72) Inventor: Christian Kada, Leibnitz (AT)

(73) Assignee: KaWaTec GmbH, Leibnitz (AT)

( * ) Notice: Subject to any disclaimer, the term of this patent is extended or adjusted under 35 U.S.C. 154(b) by 0 days.

(21) Appl. No.: 17/411,276

(22) Filed: Aug. 25, 2021

(65) Prior Publication Data

US 2022/0065577 A1 Mar. 3, 2022

(30) Foreign Application Priority Data

Aug. 26, 2020 (AT) ..... A 50717/2020

(51) Int. Cl.
*F41A 19/10* (2006.01)
*F41A 17/46* (2006.01)
*F41A 19/16* (2006.01)

(52) U.S. Cl.
CPC ..... *F41A 19/10* (2013.01); *F41A 17/46* (2013.01); *F41A 19/16* (2013.01)

(58) Field of Classification Search
CPC ..... F41A 19/10; F41A 17/22; F41A 35/06
See application file for complete search history.

(56) References Cited

U.S. PATENT DOCUMENTS 1,307,594 A * 6/1919 Newman ..... F41A 1/04 42/106
6,526,683 B1 * 3/2003 Crandall ..... F41A 19/09 42/75.01
10,345,074 B1 7/2019 Zamlinsky

FOREIGN PATENT DOCUMENTS

DE 202005009446 U1 * 11/2006 ..... F41A 3/10
IL 95455 A 8/1993
WO 2018185540 A1 10/2018

OTHER PUBLICATIONS

Office Action in Austria Application No. A 50717/2020, dated Dec. 17, 2020, 3 pages.

* cited by examiner

*Primary Examiner* — Reginald S Tillman, Jr.
(74) *Attorney, Agent, or Firm* — Lang & Hennessey LLP; Brian Hennessey

(57) ABSTRACT

In the case of a trigger device for a buttstock loader including a trigger rod for triggering an impact device of the buttstock loader with a first end of the trigger rod, it is suggested that the trigger device further includes a trigger lever, wherein the trigger rod is at least indirectly connected to the trigger lever by means of a pivot joint, wherein the trigger lever includes a trigger tongue and an extension wherein the pivot joint is arranged substantially between the trigger tongue and the extension, wherein the extension comprises a first abutment surface for at least indirectly abutting against a second abutment surface of the buttstock loader, so that upon actuation of the trigger tongue with a first force the trigger rod moves with a second force, which second force is greater than the first force, in the direction of the first end of the trigger rod.

18 Claims, 5 Drawing Sheets

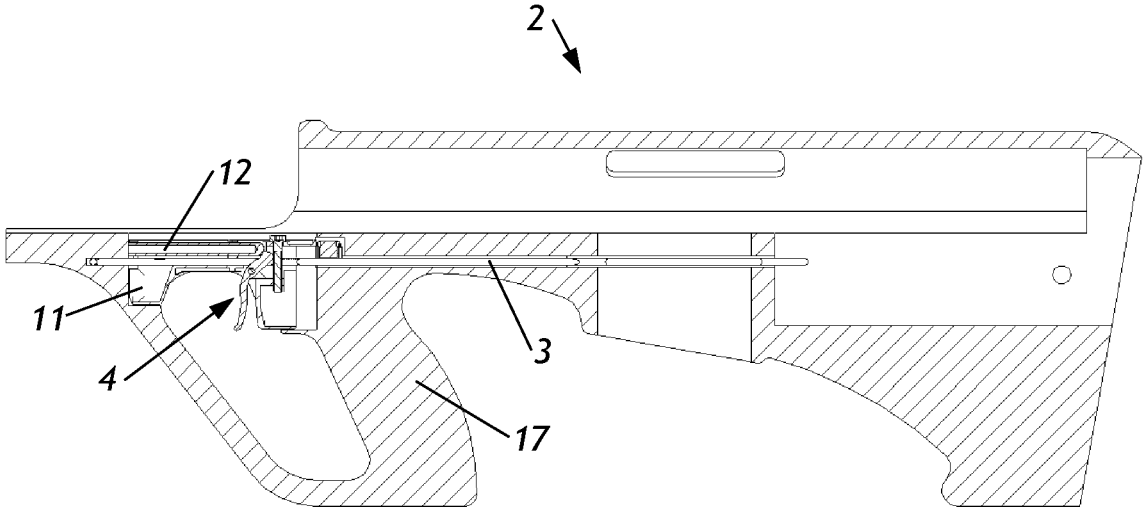
FIG. 8
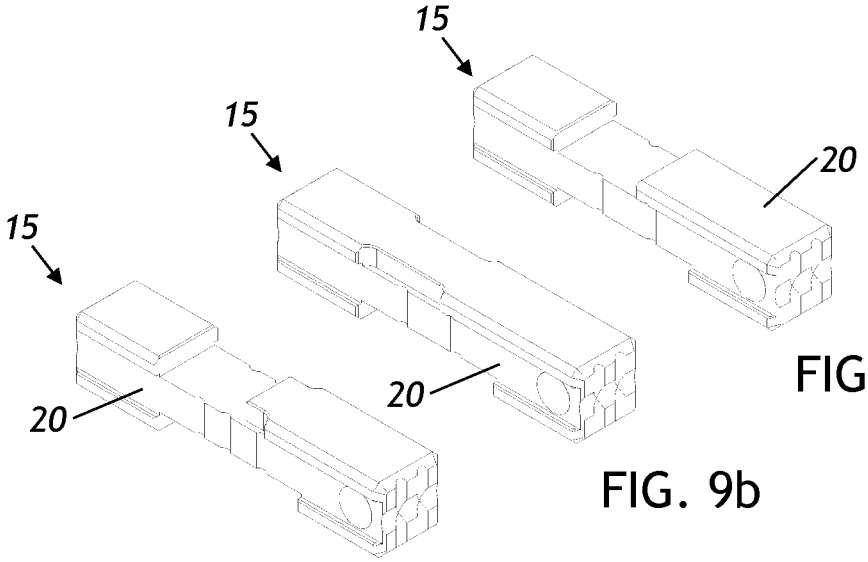
FIG. 9c
FIG. 9b
FIG. 9a

TRIGGER DEVICE FOR A BUTTSTOCK LOADER

CROSS-REFERENCE TO RELATED APPLICATIONS

The present application claims the benefit of Austrian Patent Application No. A 50717/2020, filed Aug. 26, 2020, entitled "TRIGGER DEVICE FOR A BUTTSTOCK LOADER", which is incorporated by reference in its entirety.

BACKGROUND OF THE INVENTION

1. Field of the Invention

The invention relates to a trigger device.

2. Description of the Related Art

Rear-loading rifles, in particular bullpup rifles such as the Steyr AUG rifle or rifles of the Thales assault rifle series, have a trigger system or a trigger device that is guided linearly in a recess in the stock. This trigger system is used to actuate a striker, which is usually inserted as a module in a rear section of the stock. The striker essentially comprises a housing, a cock, striker springs, a breaker system, a detent system, a bolt catch, pins, a safety catch and a trigger spring. By design, the parts are matched to each other to provide enough firing energy and to make the system functionally safe and drop-proof. Since such weapon systems were originally designed as military and official weapons, not too much attention was paid to the trigger characteristics and trigger resistance.

The trigger blade is firmly connected to the trigger rod. When the trigger blade is actuated, the trigger rod is moved in the direction of the striking device. Due to its size and the large number of individual components, the weight of the parts, the weight of the trigger system is significantly higher than that of many non-linear trigger systems. Due to the linear triggering, the drop safety is negatively affected by the mass inertia of this heavy trigger device. Therefore, as a rule, the spring force of the striking device is often increased in order to achieve a higher drop safety.

However, the disadvantage of this is that the trigger resistance is greatly increased by the increase in spring force. Inexperienced shooters have difficulty keeping their sights on the target when operating such a trigger device and often trigger unintentional bursts of fire with automatic weapons.

It is known to improve the trigger characteristics by means of different spring sets, so-called trigertamers or polished components by reducing the trigger resistance of the firing mechanism.

However, the major disadvantage of these components for the impact device is that the drop safety is reduced because the fine-tuning of the components and springs is lost. It is therefore not expedient to modify the trigger mechanism in order to achieve a lower trigger resistance, since this always has a negative effect on drop safety.

SUMMARY OF THE INVENTION

It is therefore the task of the invention to specify a trigger device of the type mentioned at the beginning, with which the disadvantages mentioned can be avoided, with which the trigger resistance can be reduced without the drop safety being negatively influenced.

According to the invention, this is achieved by a trigger device for a buttstock loader that includes a trigger rod for triggering a striking device of the buttstock loader with a first end of the trigger rod. The trigger device includes a trigger lever. The trigger rod is at least indirectly connected to the trigger lever by a pivot joint, and the trigger lever has a trigger tongue and an extension. The pivot joint is arranged substantially between the trigger tongue and the extension. The extension includes a first abutment surface for at least indirectly abutting against a second abutment surface of the buttstock loader, so that upon actuation of the trigger tongue with a first force the trigger rod moves with a second force, which second force is greater than the first force, in the direction of the first end of the trigger rod.

This results in the advantage that the trigger resistance is significantly reduced without negatively affecting the drop safety. As a result, the striking device does not have to be modified, whereby the drop safety is not negatively influenced. In that the trigger device comprises a trigger lever, the trigger rod being connected to the trigger lever at least indirectly by means of a pivot joint, the trigger lever having a trigger tongue and an extension, the pivot joint being arranged substantially between the trigger tongue and the extension, the trigger device can be operated particularly easily, thereby increasing the aiming accuracy of a shooter. This allows leverage of the trigger and a particularly good gear ratio. Instead of applying a lot of force quickly over a short distance, the force can thus be applied in a metered manner over a longer distance. Due to the leverage effect, the applied force is further increased.

Due to the design of the trigger system according to the invention, the trigger system can be easily installed in an existing buttstock loader, in particular in a Steyr AUG rifle or in rifles of the Thales assault rifle series, and the existing trigger system can be easily replaced by the trigger system according to the invention.

The invention further relates to a buttstock loader.

The invention therefore also has the task of specifying a buttstock loader of the type mentioned above, with which the disadvantages mentioned can be avoided, with which safe handling and precise shooting is made possible.

According to the invention, this is achieved by a buttstock loader having a trigger device according to the description above.

The advantages of the buttstock loader correspond to the advantages of the above-mentioned trigger device.

The subclaims concern further advantageous embodiments of the invention.

Express reference is hereby made to the wording of the patent claims, whereby the patent claims are incorporated by reference into the description at this point and are deemed to be reproduced verbatim.

If the distance from the center of a finger contact surface of the trigger blade to the pivot joint is greater than the distance from the center of the first stop surface to the pivot joint, this has the advantage of enabling a particularly good ratio, in particular greater than or equal to 2. This leverage allows the trigger blade to be actuated particularly precisely and thus a shot to be fired in a particularly controlled manner.

BRIEF DESCRIPTION OF THE DRAWINGS

The invention is described in more detail with reference to the enclosed drawings, in which only preferred embodiments are shown by way of example. Thereby shows:

FIG. 8 is a schematic illustration of a portion of the preferred embodiment of a rear shank loader showing the trigger assembly and a larger view of the rear shank loader housing in longitudinal section;

FIGS. 9*a*-9*c* schematic illustrations of three preferred embodiments of a safety slide;

DETAILED DESCRIPTION

Figure 1:
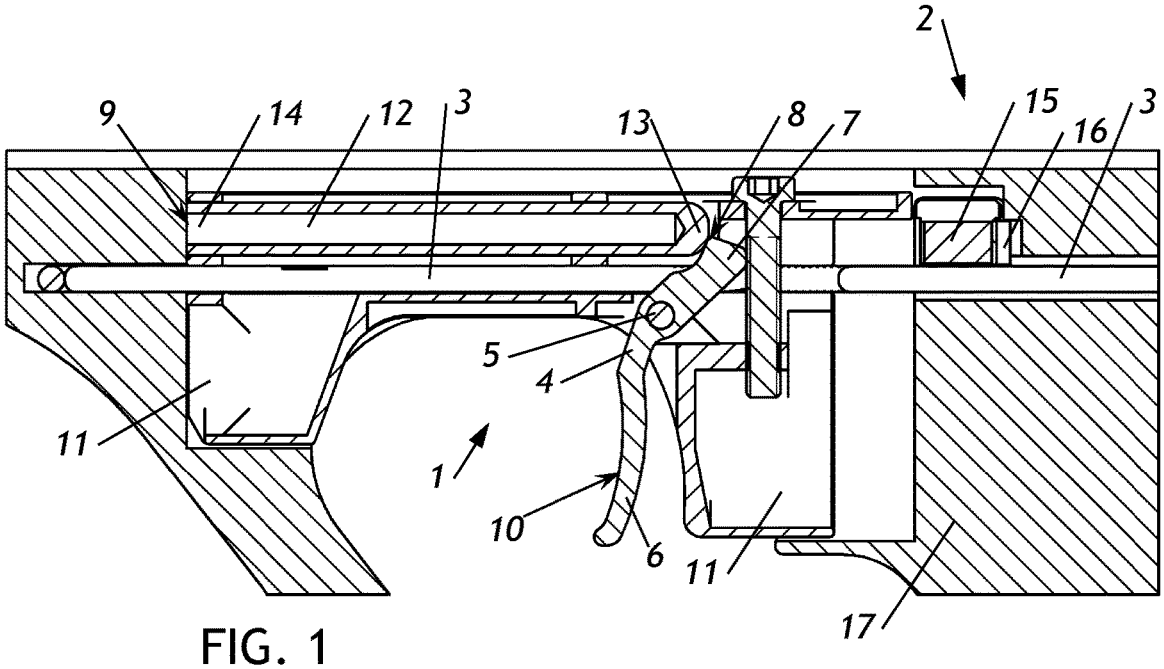
FIG. 1 is a schematic illustration of a preferred embodiment of an rear stock loader with a trigger device in the rest position in a longitudinal section.
Figure 2:
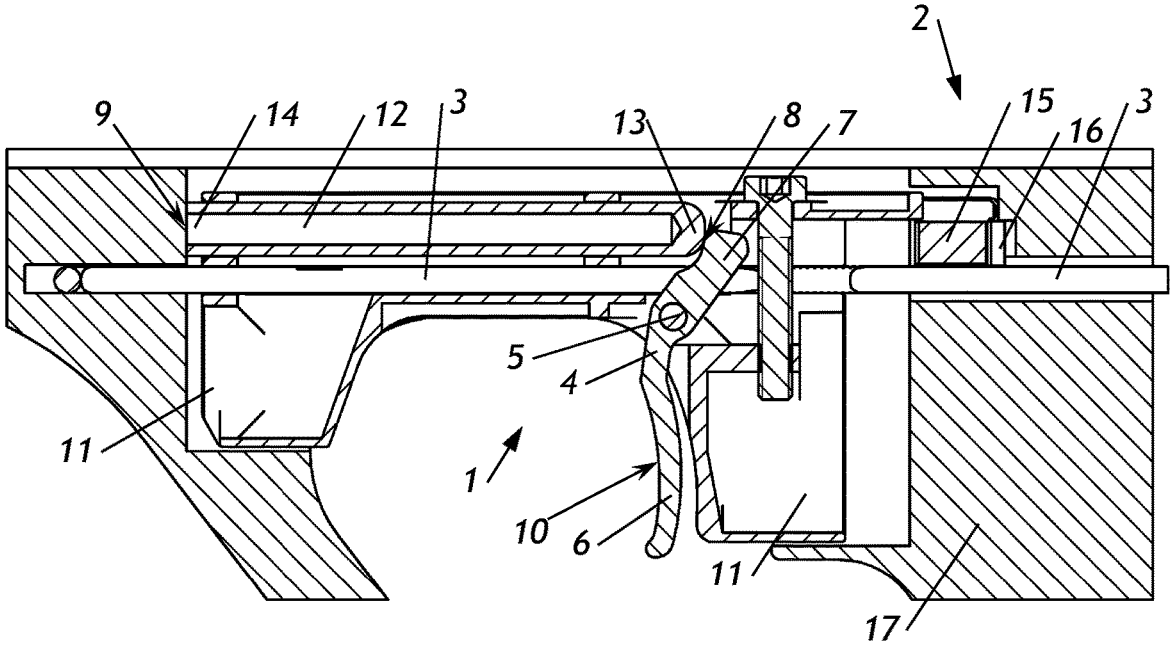
FIG. 2 is a schematic illustration of the preferred embodiment of a rear-shaft loader with the trigger device at the pressure point in the longitudinal section.
Figure 3:
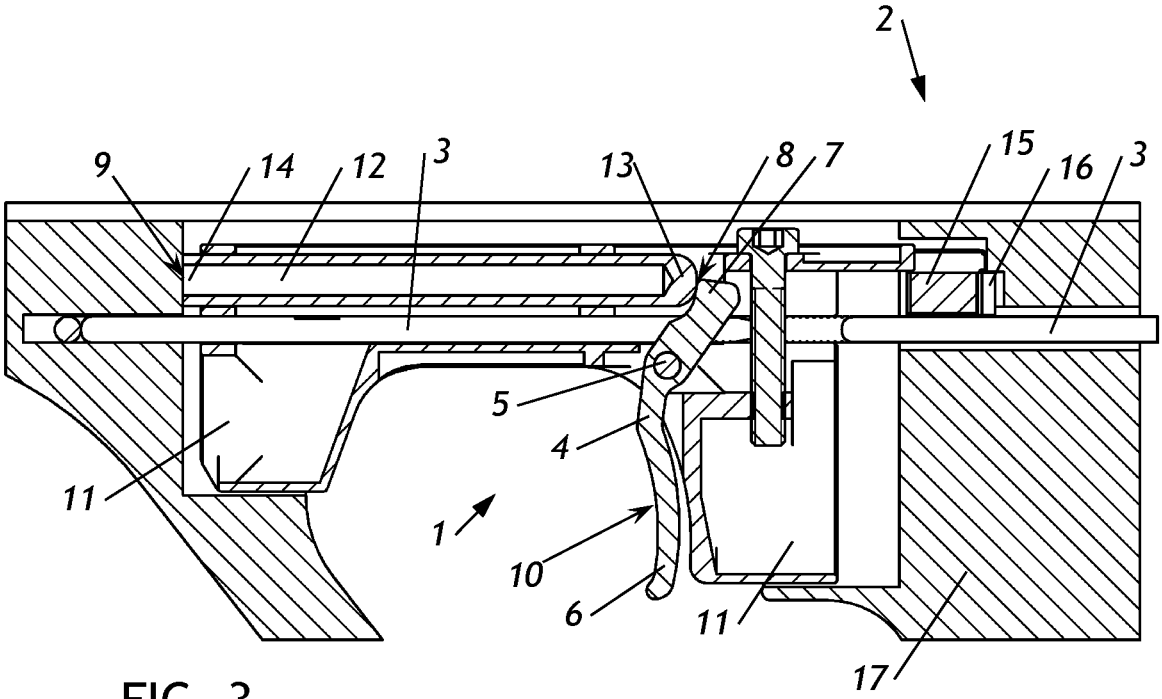
FIG. 3 is a schematic illustration of the preferred embodiment of a rear-shaft loader with trigger released in the longitudinal section.

FIGS. 1 to 11 show at least parts of a preferred embodiment of a trigger device 1 for a buttstock loader 2 comprising a trigger rod 3 for triggering a striking device of the buttstock loader 2 with a first end of the trigger rod 3, wherein the trigger device 1 further comprises a trigger lever, wherein the trigger rod 3 is connected to the trigger lever 4 at least indirectly by means of a pivot joint, wherein the trigger lever 4 has a trigger tongue 6 and an extension 7, the pivot joint 5 being arranged substantially between the trigger tongue 6 and the extension 7, the extension 7 having a first abutment surface 8 for at least indirectly bearing against a second abutment surface 9 of the buttstock loader 2, so that when the trigger tongue 6 is actuated with a first force, the trigger bar 3 moves with a second force, which second force is greater than the first force, in the direction of the first end of the trigger bar 3.

A buttstock loader 2 comprising a trigger device 1 is also provided.

This has the advantage that the trigger resistance is significantly reduced without negatively affecting the drop safety. Through this, the striking device does not have to be modified, whereby the drop safety is not negatively influenced. By the fact that the trigger device 1 comprises a trigger, wherein the trigger rod 3 is at least indirectly connected to the trigger 4 by means of a pivot joint, wherein the trigger 4 has a trigger tongue 6 and an extension 7, wherein the pivot joint 5 is arranged substantially between the trigger tongue 6 and the extension 7, the trigger device 1 can be actuated particularly easily, whereby the aiming accuracy of a shooter is increased. This allows for leverage of the trigger 4 and a particularly good gear ratio. Instead of applying a lot of force quickly over a short distance, the force can thus be applied in a metered manner over a longer distance. Due to the leverage effect, the applied force is further increased.

Due to the constructive design of the trigger device 1 according to the invention, the trigger device 1 can be installed in an existing buttstock loader 2, in particular in a Steyr AUG rifle or in rifles of the Thales assault rifle series, particularly easily in just a few steps, and it is particularly easy to replace the existing trigger device there with the trigger device 1 according to the invention.

A breech-loading rifle 2 is known in particular as a bullpup rifle. This designates a type of long gun in which the breech and often also the magazine are located behind the grip in the shoulder rest. The trigger device 1 is used to trigger the buttstock loader 2. The trigger rod 3, in particular a first end of the trigger rod 3, triggers the striker device of the buttstock loader 2. The trigger device 1 comprises the trigger lever 4, wherein the trigger rod 3 is at least indirectly connected to the trigger lever 4 by means of a pivot joint 5. The trigger lever 4 has a trigger tongue 6 and an extension 7, wherein the pivot joint 5 is arranged substantially between the trigger tongue 6 and the extension 7. The extension 7 has a first stop surface 8 for at least indirect support on a second stop surface 9 of the buttstock loader 2. When the trigger blade 6 is actuated with a first force, the trigger rod 3 moves with a second force, which second force is greater than the first force, in the direction of the first end of the trigger rod 3. The trigger lever 4 thus serves for lever transmission. The trigger resistance is the resistance that must be overcome to trigger a shot.

Preferably, the trigger bar 3 can be designed as a trigger fork 18. This makes it particularly easy to arrange the trigger lever 4 or the extension 7 between the fork of the trigger fork 18 and it is not necessary to create a recess for the trigger lever 4 or the extension 7.

For this purpose, it can also be provided that the trigger fork 18 is somewhat recessed so that the trigger lever 4 or the extension 7 are arranged freely movable in the trigger fork 18.

It may also be preferable to remove a pressure arm 19 of the trigger fork 18 in order to reduce the overall weight of the trigger device 1. It has been found that one pressure arm 19 is already sufficient for safe operation.

Alternatively, to reduce the overall weight of the trigger device 1, multiple recesses can be created in the trigger fork 18.

It may be particularly preferred that the distance of the center of a finger support surface 10 of the trigger blade 6 to the pivot joint 5 is greater than the distance of the center of the first stop surface 8 to the pivot joint 5, which is exemplarily shown in FIGS. 1 to 4 and 8. The finger resting surface 10 of the trigger blade 6 is that surface on which a user rests his finger when operating the trigger 4. Due to the greater distance of the center point of the finger support surface 10 to the pivot joint 5 than the distance of the center point of the first stop surface 8 to the pivot joint 5, a particularly good transmission ratio, in particular greater than or equal to 2, and thus a particularly good leverage effect is made possible. This leverage allows the trigger blade 6 to be actuated particularly precisely and thus a shot to be fired in a particularly controlled manner.

Figure 4:
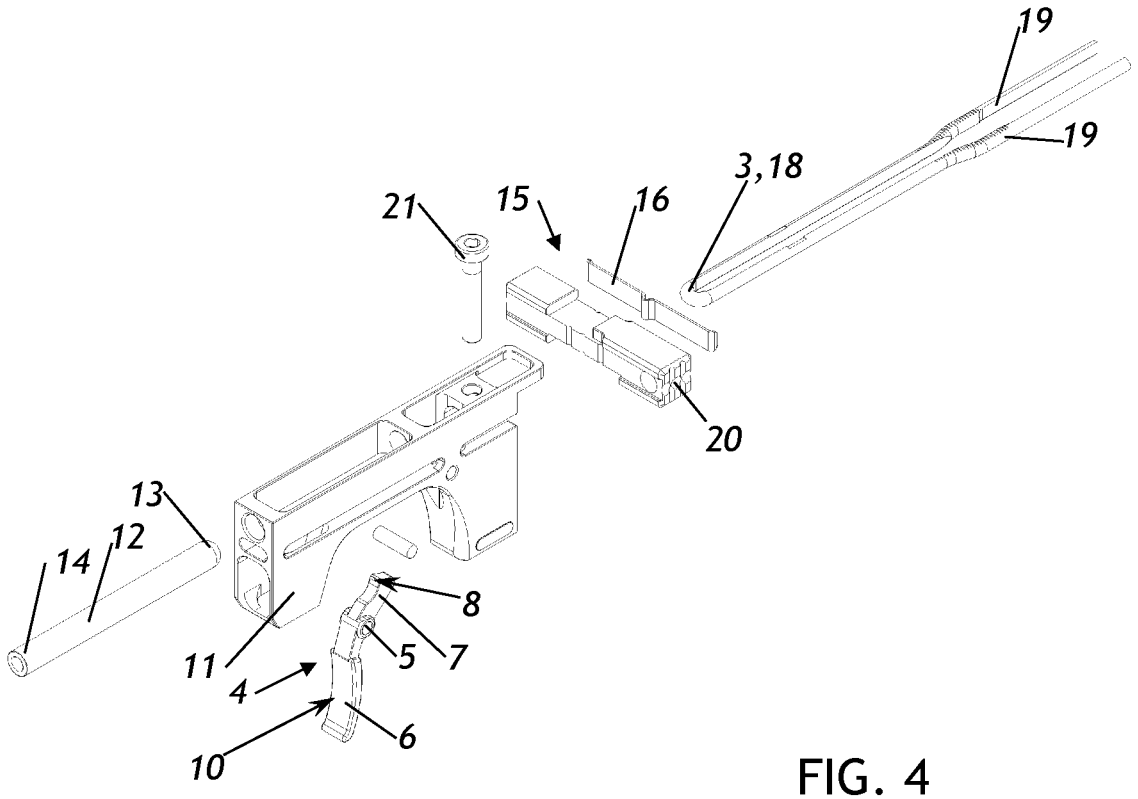
FIG. 4 is an exploded view of the preferred embodiment of the take-off device.
Figure 5:
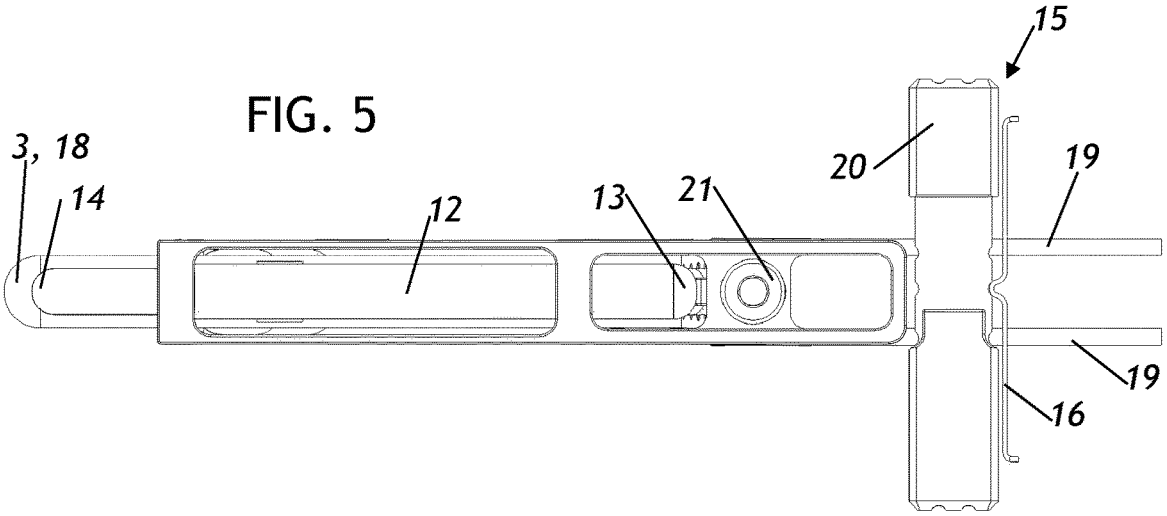
FIG. 5 a schematic illustration of the preferred embodiment of the trigger device in rest position in top view.
Figure 6:
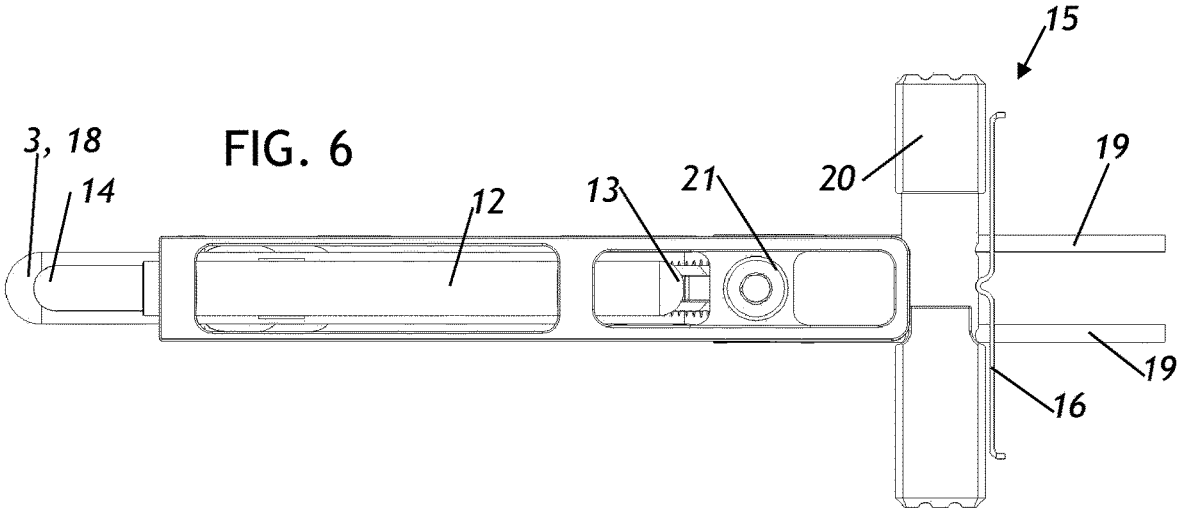
FIG. 6 is a schematic top view of the preferred embodiment of the trigger device at the pressure point.
Figure 7:
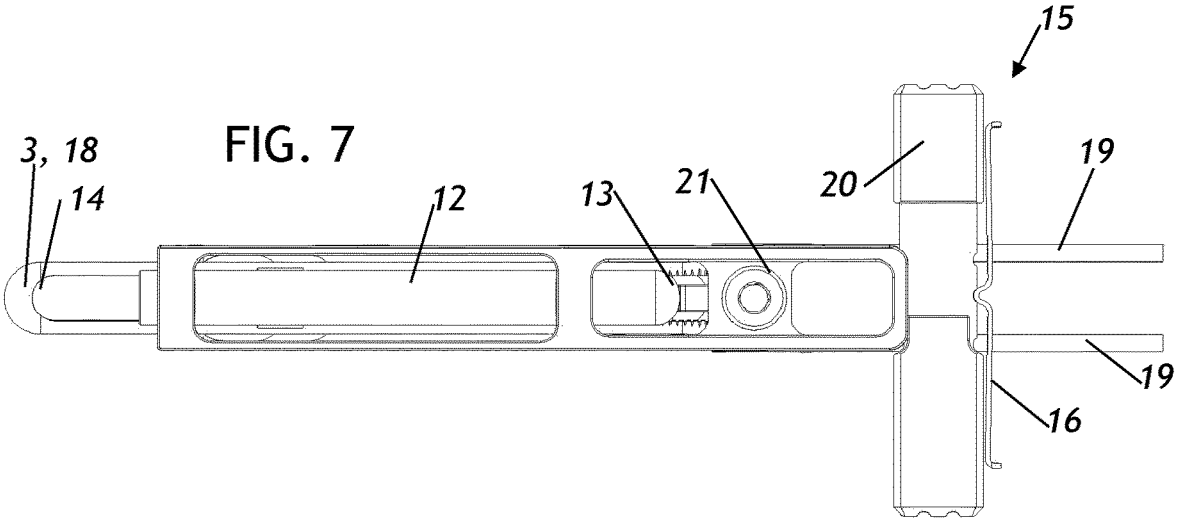
FIG. 7 a schematic illustration of the preferred embodiment of the triggered trigger device in plan view.
Figure 10:
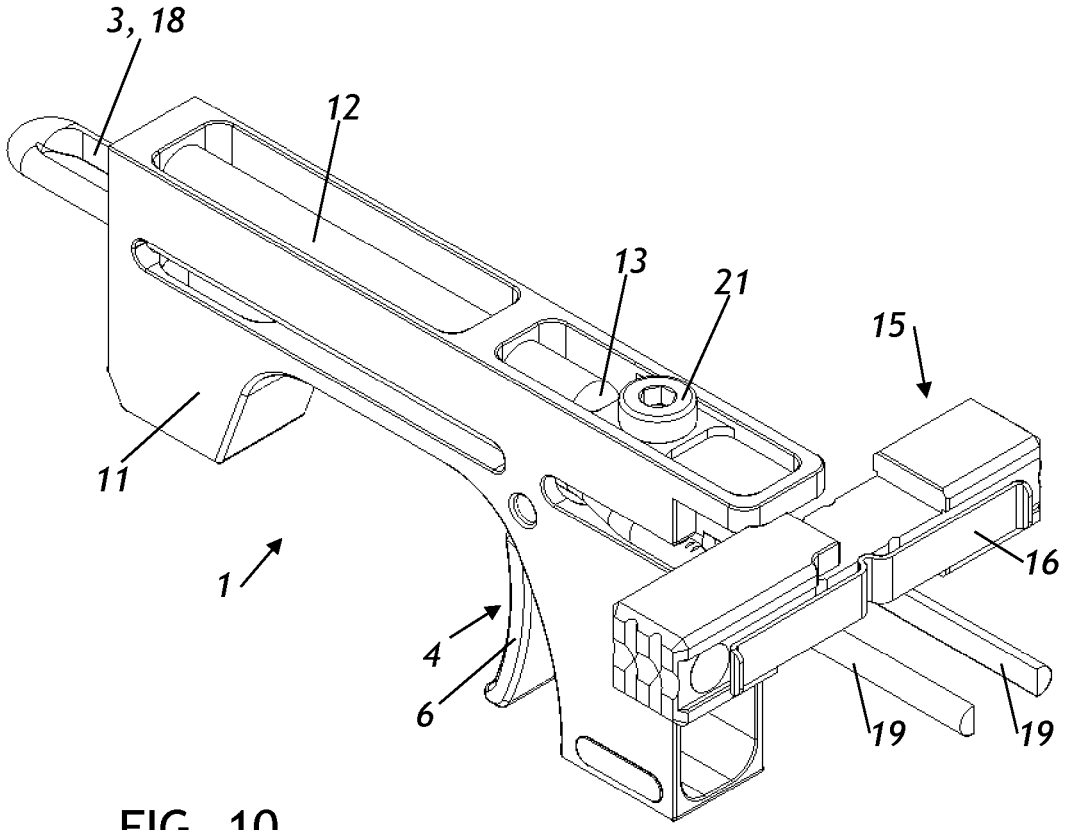
FIG. 10 a schematic illustration of the preferred embodiment of the trigger device in a first perspective view, and FIG. 11 a schematic illustration of the preferred embodiment of the trigger device in a second perspective view.
Figure 11:
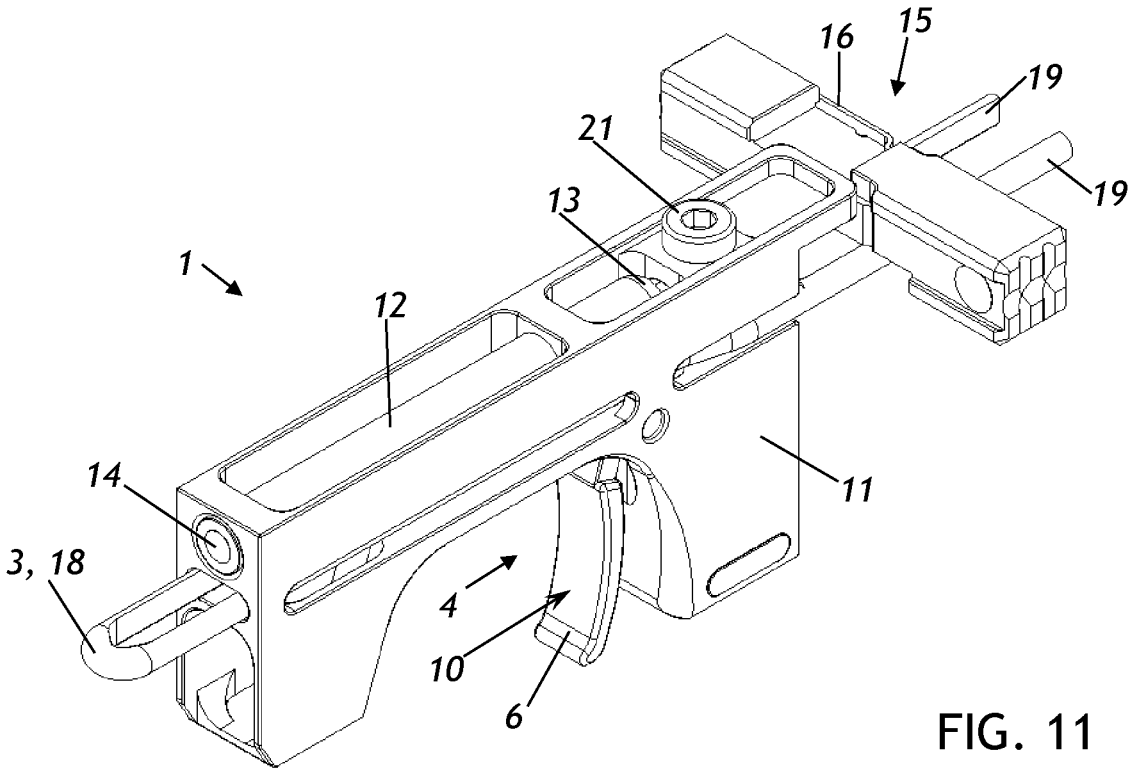

For this purpose, it can be provided that a longitudinal extension of the trigger blade 6 is longer than a longitudinal extension of the extension 7, which is exemplarily shown in FIG. 4.

It may be provided that the trigger rod 3 has a length of at least 5 cm, preferably at least 10 cm, in particular at least 15 cm.

It may be particularly preferred that the fume cupboard 1 comprises a fume cupboard housing 11. The trigger housing 11 is preferably made of plastic or metal, in particular aluminum. Preferably, it can be provided that the trigger housing 11 has a recess for the trigger lever 4 or the extension 7.

Particularly preferably, it can be provided that the trigger 4 is rotatably mounted to the trigger housing 11 by means of the pivot joint 5.

It may further be provided that the trigger rod 3 is firmly connected to the trigger housing 11.

It can preferably be provided that a pressure pin 12 for transmitting a pressure force between the first stop surface 8 and the second stop surface 9 is guided linearly in the trigger housing 11 and is mounted so as to be movable parallel to the trigger rod 3. For this purpose, it can preferably be provided that the trigger housing 11 has a recess, in particular a cylindrical recess, for the pressure pin 12, which is shown by way of example in FIGS. 4, 10 and 11. The pressure pin 12 can preferably be made of metal, in particular aluminum, or plastic. The cylindrical recess allows the pressure pin 12 to be mounted in the trigger housing 11 in a particularly simple and secure manner After actuation of the trigger 4, the pressure pin 12 moves linearly and parallel to the trigger rod 3.

Particularly preferably, provision can be made for the first stop surface 8 to bear against a first end 13 of the pressure pin 12 and for a second end 14 of the pressure pin 12 to bear against the second stop surface 9 to be arranged on an end face of the trigger housing 11.

When the trigger blade 6 is actuated, the first stop surface 8 presses on the first end 13 of the pressure pin 12 and the pressure pin 12 presses with its second end 14 on the second stop surface 9 of the buttstock loader 2, as a result of which the trigger device 1, and thus also the trigger rod 3, is moved in the direction of the striking device and the striking device is triggered.

Thus, a rotary movement of the trigger blade 6 and thus of the trigger lever 4 about the rotary joint 5 triggers a linear movement of the trigger rod 3 in a trigger direction. The trigger direction here is the direction in which the trigger bar 3 is pulled after actuation of the trigger lever 4. In other words, the trigger direction runs from the second end 14 of the pressure pin 12 to the first end 13 of the pressure pin 12 or from the barrel opening of the firearm along the barrel to a shoulder piece of the firearm.

It may preferably be provided that an axis of the swivel joint 5 is normal to the pull-off direction of the pull-off rod 3.

It can preferably be provided that the trigger device 1 has a safety device 15 comprising a safety spring 16, the safety device 15 at least indirectly inhibiting a movement of the trigger rod 3 in a trigger direction in a locked position.

The safety spring 16 can preferably be designed as a leaf spring, which is shown by way of example in FIGS. 5 to 7 and 10. When the trigger 4 is actuated, the safety spring 16 is pressed in the trigger direction, creating a clearly defined pressure point. When this pressure point is overcome, a shot is fired. In the exemplary illustration in FIG. 5, the trigger lever 4 is in the rest position, in the exemplary illustration in FIG. 6, the trigger lever 4 is released to such an extent that the pressure point is reached, and in the exemplary illustration in FIG. 7, the trigger mechanism 1 is released.

Particularly preferably, it can be provided that the safety device 15 comprises a safety slide 20. FIGS. 9*a* to 9*c* show examples of different versions of the safety slide 20.

Preferably, the safety device 15 can be made somewhat narrower than the original safety device and a stop can be made in an opening for the trigger or in the trigger housing 11. This narrower safety device 15 is pressed in the trigger direction by the safety spring 16. When the trigger blade 6 is actuated, the trigger housing 11 together with the trigger fork 18 is pressed up to this stop. Shortly before the firing mechanism is triggered, the safety device 15 must now also be pressed in the direction of the firing mechanism. This additional spring pressure of the safety spring 16 creates a clear pressure point shortly before the shot is released.

The safety device 15 can preferably be a 3-position safety device, which is exemplarily shown in FIG. 9*a*. The first position is secured, and the second position is with a pressure point, whereby only single fire can be released. The third position is without a pressure point, so that in a fully automatic version it is also possible to fire continuously. This 3-position safety allows the shooter to choose between "with pressure point" and "without pressure point".

FIG. 9*b* shows an example of a 2-position safety device, whereby a choice can be made between a safe position and a position with a pressure point. FIG. 9*c* shows an example of a 2-position safety device, whereby a choice can be made between a safe position and a position without a pressure point.

Preferably, by moving the safety slide 20, it is possible to select between a secured position, a position with a pressure point and a position without a pressure point. In the position with the pressure point, the trigger housing 11 in particular abuts against the safety device 15.

It may be particularly preferred that the safety slide 20 and the safety spring 16 are arranged to be displaceable in the trigger direction. When the trigger 4 is actuated, the safety slide 20 and the safety spring 16 in particular are displaced along the trigger direction.

The safety spring 16 additionally increases the perceptible resistance at the pressure point, allowing a particularly well-aimed single fire to be delivered.

Preferably, it may be provided that a trigger point at which a shot is fired is located between the pressure point and an end point.

In particular, it may be provided that a first lateral longitudinal side of the safety slide 20 is formed mirrored to a second lateral longitudinal side of the safety slide 20. Thus, the safety slide 20 can be used rotated by 180° so that the safety device 15 can be adapted for use by a left-handed person.

It may preferably be provided that the buttstock loader 2 comprises a buttstock loader housing 17, wherein substantially in the buttstock loader housing 17 the trigger housing 11 is arranged, which is exemplarily shown in FIG. 8.

In particular, the buttstock loader housing 17 substantially corresponds to the stock of the firearm.

It may be further preferred that the trigger housing 11 is arranged to be displaceable in the trigger direction relative to the rear shaft loader housing 17. When the trigger lever 4 is actuated, essentially the entire trigger housing 11 is displaced relative to the rear shank loader housing 17 in the trigger direction.

When assembling the trigger mechanism 1 in the rear stock loader housing 17, the trigger mechanism 1 together with the trigger lever 4 is preferably first inserted from above into a recess in the rear stock loader housing 17 and then the trigger rod 3, in particular the trigger fork 18, is inserted through another recess in the rear stock loader housing 17 from behind through a through opening in the trigger housing 11. The parts assembled in this manner are then screwed together with a cap screw 21.

The following are principles for understanding and interpreting representational revelation.

By means of an ordering number word, for example "first", "second" or "third", in particular a feature X or an object Y is distinguished in several embodiments, unless otherwise defined by the disclosure of the invention. In particular, a feature X or subject matter Y with an ordering numeral in a claim does not mean that an embodiment of the invention covered by that claim must have a further feature X or a further subject matter Y, respectively.

The invention claimed is:

1. A trigger device for a buttstock loader, comprising:

a trigger rod for triggering a striking device of the buttstock loader with a first end of the trigger rod;

a trigger housing movable relative to the buttstock loader; and a trigger lever;

wherein the trigger rod is at least indirectly connected to the trigger lever by a pivot joint;

wherein the trigger lever has a trigger tongue and an extension;

wherein the pivot joint is arranged substantially between the trigger tongue and the extension; and wherein the extension comprises a first abutment surface for at least indirectly abutting against a second abutment surface of the buttstock loader, so that upon actuation of the trigger tongue with a first force the trigger rod moves with a second force, which second force is greater than the first force, in a direction of a first end of the trigger rod.

2. The trigger device according to claim 1, wherein a first distance of the center of a finger support surface of a trigger blade to the pivot joint is greater than a second distance of the center of a first stop surface to the pivot joint.

3. The trigger device according to claim 1, wherein the trigger lever is mounted rotatably relative to the trigger housing by means of the pivot joint.

4. The trigger device according to claim 1, wherein a pressure pin for transmitting a pressure force between a first stop surface and a second stop surface is guided linearly in the trigger housing and is mounted so as to be movable parallel to the trigger rod.

5. The trigger device according to claim 4, wherein the first stop surface rests against a first end of the pressure pin, the first stop surface being coupled to the extension, and that a second end of the pressure pin rests against the second stop surface on an end face of the trigger housing.

6. The trigger device according to one of claim 1, further comprising a safety device comprising a safety spring, the safety device at least indirectly inhibiting a movement of the trigger rod in a trigger pull direction in a locked position.

7. The buttstock loader comprising a trigger device according to claim 1.

8. The buttstock loader according to claim 7, wherein:

the trigger device comprises a trigger housing;

the buttstock loader comprises a buttstock loader housing; and the trigger housing is arranged substantially in the buttstock loader housing.

9. The buttstock loader according to claim 8, wherein the trigger housing is arranged displaceably in the trigger pull direction relative to the buttstock loader housing.

10. The buttstock loader according to claim 6, wherein the safety device is a 3-position safety device, a first position of the safety device preventing firing of the weapon, a second position of the safety device having a pressure point whereby only a single fire is released with each trigger pull, and a third position of the safety device not having a pressure point whereby repeated firing occurs with each trigger pull.

11. The buttstock loader according to claim 1, wherein the trigger housing is movable in a trigger pull direction relative to the buttstock loader.

12. The trigger device according to claim 1, wherein the trigger rod moves only linearly relative to the buttstock loader when the trigger tongue is actuated.

13. The trigger device according to claim 1, wherein the safety device further comprises a first lateral longitudinal side and a second lateral longitudinal side mirroring the first lateral longitudinal side, the safety slide being rotatable by 180° for use by a left-handed person.

14. A trigger apparatus for a buttstock loader, comprising:

a trigger lever coupled to a trigger housing by a pivot joint, the trigger lever having a trigger tongue and an extension, the pivot joint being arranged between the trigger tongue and the extension;

a pressure pin coupled to the extension and slideably coupled to the trigger housing, the pressure pin engaging an abutment surface of the buttstock loader; and a trigger rod having a first end configured to trigger a striking device of the buttstock loader, the trigger rod being fixedly mounted to the trigger housing.

15. The trigger apparatus according to claim 14, wherein actuation of the trigger tongue in a trigger pull direction with a first force causes the pressure pin to engage the abutment surface of the buttstock loader and move the trigger housing in the trigger pull direction.

16. The trigger apparatus according to claim 15, wherein actuation of the trigger tongue in the trigger pull direction with the first force causes the trigger rod to move in the trigger pull direction with a second force, the second force being greater than the first force.

17. The trigger apparatus according to claim 15, further comprising a safety device comprising a safety spring, the safety device at least indirectly inhibiting a movement of the trigger rod in a trigger pull direction in a locked position, the safety device further comprising a first lateral longitudinal side and a second lateral longitudinal side mirroring the first lateral longitudinal side, the safety slide being rotatable by 180° for use by a left-handed person.

18. A safety device for a trigger apparatus, comprising:

a safety slide interposed between a trigger and a trigger rod, a first lateral longitudinal side of the safety slide mirroring a second lateral longitudinal side of the safety slide, the safety slide being rotatable by 180° for use by a left-handed person; and a safety spring;

wherein the safety device at least indirectly inhibits a movement of the trigger rod in a trigger pull direction in a locked position.

* * * * *